United States Patent [19]

Criswell

[11] 3,938,291

[45] Feb. 17, 1976

[54] GLAZING PANEL SUPPORT SYSTEM

[76] Inventor: Homer C. Criswell, 2608 Black Oak Lane, Arlington, Tex. 76012

[22] Filed: Sept. 3, 1974

[21] Appl. No.: 502,766

[52] U.S. Cl. ..... 52/731; 52/400; 52/584; 52/627

[51] Int. Cl.[2] ..... E04C 3/30

[58] Field of Search ..... 52/731, 403, 400, 235, 52/397, 461, 627, 214, 127, 716, 584, 588; 49/487, 493, 486

[56] References Cited

UNITED STATES PATENTS

| | | | |
|---|---|---|---|
| 2,570,169 | 10/1951 | Verhagen | 52/584 |
| 2,962,133 | 11/1960 | Kivett | 52/584 |
| 3,336,707 | 8/1967 | Horgan | 52/400 |
| 3,363,381 | 1/1968 | Forrest | 52/584 |
| 3,699,735 | 10/1972 | Smith | 52/400 |
| 3,766,698 | 10/1973 | Dallen | 52/400 |
| 3,785,104 | 1/1974 | Dailen | 52/235 X |

*Primary Examiner*—Frank L. Abbott
*Assistant Examiner*—Robert Farber
*Attorney, Agent, or Firm*—Jack A. Kanz

[57] ABSTRACT

Disclosed is a glazing panel support system including an expansion zipper wedge which supports the gasket. The system includes mullions comprised of parallel plates with inwardly projecting legs which mate with grooves in the gasket. The mullion plates are internally interlocked to provide a mullion and gasket system wherein the expansion wedge and the mullion panel interlocking means are totally concealed.

4 Claims, 4 Drawing Figures

GLAZING PANEL SUPPORT SYSTEM

This invention relates to curtain wall construction. More particularly, it relates to interlocking panels forming support mullions for curtain wall gaskets. The mullion is comprised of two interlocked panels having the interlocking mechaniism totally internally concealed.

Elastomeric gaskets are conventionally employed for retaining curtain wall panels within an open space defined by a structural framework. The wall usually includes separate panel framing elements attached to one face of the structural framework and panels supported within the framework. The panels are ordinarily glass or other rigid material. The framework is generally composed of a number of extruded metal members joined to form a single module having grooves defined therein for retaining an elastomeric gasket. The gasket contains grooves running along the length thereof for insertion of the curtain wall panel. Ordinarily the gasket strip includes a wedge-shaped member insertible in a wedge-receiving recess in the gasket strip opposite the mounting support whereby the lips of the grooves in the elastomeric gasket are crowded to cause the groove to engage the glass or other rigid sheets more securely.

Glazing systems of the type described have become widely used for both internal and external non-structural walls. However, in the conventional glazing system the mullion is first erected to form the supporting framework. The gasket is then inserted in grooves in the faces of the mullions and each individual glass panel thereafter fitted within the grooves in the gasket. Ordinarily the wedge-receiving means is in the surface of the gasket opposite the mounting and support tongue. Therefore the wedge is inserted within the gasket to complete the structure after insertion of the panels within the gasket and after the gasket is supported on the mullions.

From the foregoing it will be observed that the glazing system is erected piecemeal. That is, several erections steps are involved in placing the curtain wall in the structural framework. Furthermore, the wedge zipper is exposed.

In accordance with the present invention a glazing system is provided wherein the glazing panels are inserted in the gaskets prior to placement of the gasket in the mullion framework. Furthermore, the gaskets and panels are attached to the mullion prior to erection of the mullion to the supporting framework. Accordingly, entire sections of glazing panels may be erected simultaneously in a single operation. Furthermore, in the preferred embodiment of the invention the wedge means as well as the means for interlocking the mullion members together are completely internal and totally concealed from view. Therefore, not only is the erection of the complete panel much more efficient and much quicker, the final assembly has a cleaner sight line and a much more attractive appearance.

Other features and advantages of the invention will become more readily understood when taken in connection with the appended claims and attached drawings in which:

Figure 1:
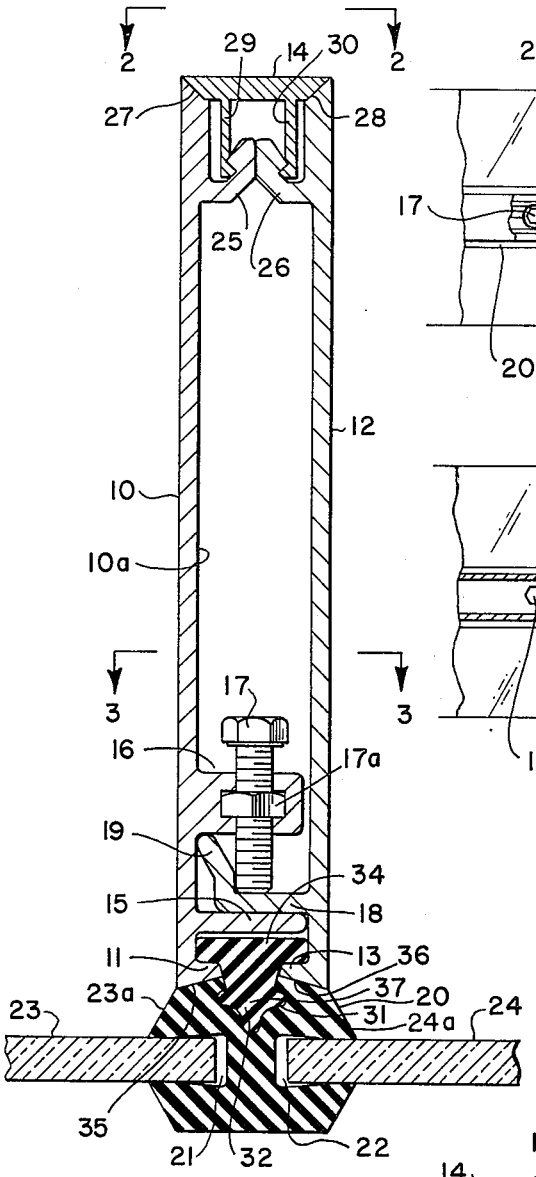
FIG. 1 is a sectional view of the preferred embodiment of the interlocking mullion panels and gasket system of the invention.

It will be readily appreciated that although the invention is described in detail herein with reference to a gasket wherein the support tongue comprises an extension of the expansion wedge, the invention is not so limited. The invention may be used with more conventional gaskets wherein the support tongue is an integral part of the gasket and extending therefrom. The expansion wedge may be opposite the support tongue or on either side of the glazing panel as in more conventional gasket systems.

In the embodiment illustrated in FIG. 1 the mullion comprises a first plate 10, a second plate 12 and an end cap 14; all adapted for interlocking relationship as described hereinafter. The gasket comprises an elongated elastomeric body 20 having opposed grooves 21 and 22 running the length thereof and adapted to receive glazing panels 23 and 24, respectively.

As illustrated in the drawings an inwardly projecting leg 11 extends from an inner surface 10a at one end of the plate 10. Likewise, the second plate 12 has an inwardly projecting leg 13 projecting from the end thereof and facing leg 11. A boss 15 also extends from the inner face 10a of the first plate. Boss 15 is spaced from the leg 11 and is preferably normal to the face 10a. In the preferred embodiment, the height of boss 15 determines the distance separating the internal surfaces of plates 10 and 12.

A second boss 16 parallel with and spaced from first boss 15 also projects from the inner surface of the first plate 10. Second boss 16 includes a hole passing therethrough parallel with the inner surface and adapted to receive a threaded stud 17. The hole in boss 16 may be threaded or, alternatively, boss 16 may contain a groove adapted to receive a nut **17*a* as illustrated in the drawing. It will thus be observed that threaded studs 17 are therefore supported within the central cavity between plates 10 and 12** and parallel with inner surface.

An interlocking boss or lug 18 projects from the inner surface of the opposite plate 12. Lug 18 is positioned to project parallel to and adjacent boss 15 and between boss 15 and boss 16 on the first plate 10. Lug 18 includes a curved lip 19 which projects upwardly and away from boss 15 toward boss 16. It will thus be observed that when the plates 10 and 12 are positioned together with lug 18 between bosses 15 and 16, advancing stud 17 through boss 16 causes the end of stud 17 to strike the inclined surface or curved lip 19 and draw the plates 10 and 12 together. The height of bosses 15 and 18, therefore, determines the distance separating the plates 10 and 12.

The ends of first and second plates 10 and 12 opposite the ends carrying legs 11 and 13 are adapted to mate with the end cap 14 which encloses the space between the plates 10 and 12. As shown in FIG. 1 this may be readily accomplished by providing plates 10 and 12 with internally projecting bosses 25 and 26. Bosses 25 and 26 are preferably symmetrical, each projecting inwardly toward the other and providing means for limiting separation between the plates 10 and 12.

In the preferred embodiment the edges 27 and 28 of the plates 10 and 12 are preferably beveled to conform to a mating beveled edge on the edges of end cap 14. End cap 14 also includes a pair of inwardly projecting clips 29 and 30 which mate with grooves on bosses 25 and 26, respectively, to hold end cap 14 in place and join plates 10 and 12 together.

It will thus be observed that with end cap 14 in place, clips 29 and 30 press bosses 25 and 26 together while urging the end cap 14 against the beveled edges 27 and 28 of the plates 10 and 12. It will therefore be observed that the end cap 14 totally encloses the interior space between the plates 10 and 12, thereby hiding the entire internal mechanism from view.

Figure 2:
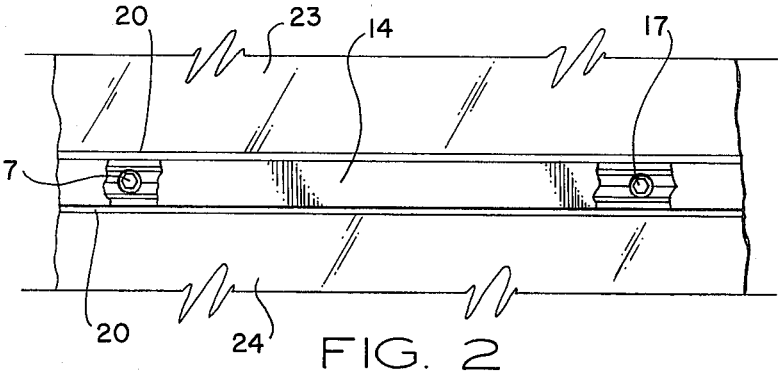
FIG. 2 is an end view of the embodiment of FIG. 1 with a portion of the end panel broken away.
Figure 3:
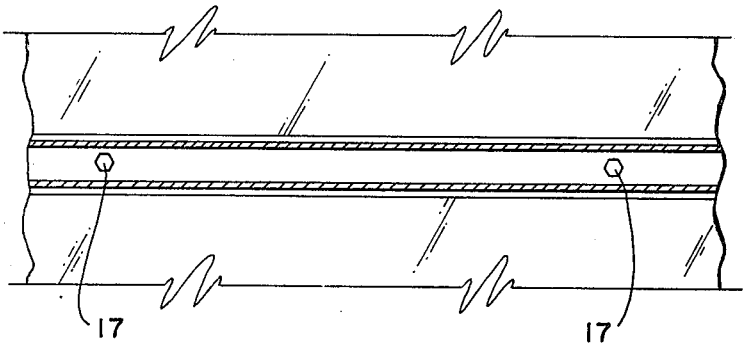
FIG. 3 is a sectional view of the embodiment of FIG. 1 taken through section lines 3—3.
Figure 4:
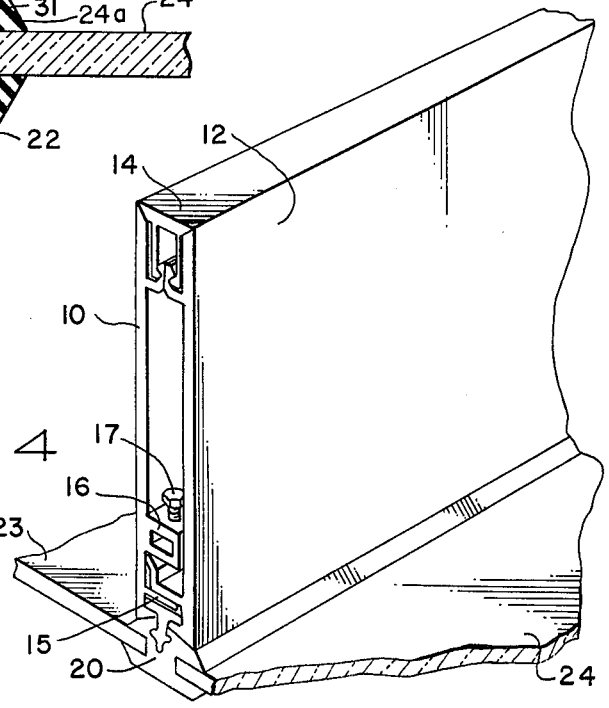
FIG. 4 is a perspective view of the embodiment of FIG. 1

As shown in FIG. 2 bosses 25 and 26 should not be continuous but should be interrupted periodically to provide access to the top of stud 17.

In the embodiment illustrated in FIG. 1 lips 23*a* and 24*a* are urged toward the glazing panels 23 and 24 respectively by the expansion wedge 32.

In the embodiment illustrated in FIG. 1 elastomeric body 20 has a wedge-receiving groove 31 traversing the length thereof along one side at substantially right angles to opposed grooves 21 and 22. Wedge-receiving groove 31 is adapted to receive and mate with the base of wedge means 32. When wedge 32 is inserted within the wedge-receiving groove 31 the lips 23*a* and 24*a* of the grooves 21 and 22, respectively, are urged to grippingly engage the panels 23 and 24, respectively, thereby providing an effective seal around the panels and the gasket.

In the preferred embodiment wedge means 32 is T-shaped in cross section. The base 37 of the wedge means fits within groove 31 while the head 34 extends laterally from the elastomeric body 20 defining grooves 35, 36 paralleling the panel grooves 21 and 22 but adapted to receive legs 11 and 13 of panels 10 and 12, respectively. It will be observed that the head 34 of the T-shaped wedge means 32 is approximately the width of the distance separating the internal surfaces of panels 10 and 12; therefore the inwardly projecting legs 11 and 13 grippingly engage the head 34 of the wedge means. The legs 11 and 13 also provide rigidity to the back side of lips 23*a* and 24*a*, thereby providing firm support for the entire elastomeric body and the panels 23 and 24 supported thereby.

It will be observed that when assembled as described above, the mullion plates fully enclose the head 34 of the wedge means and the mechanism for interlocking the panels 10 and 12 is hidden from view. The gasket, however, is supported by the wedge means and legs 11 and 13 provide support for the sides of the lips 23*a* and 24*a*. Accordingly, the entire panel system comprising gasket, glazing panels, wedge means and support mullion may be assembled as a complete wall and then raised into place for attaching to the structural supporting framework.

It will be readily understood that while the invention has been described with respect to mounting oppositely disposed panels with a single gasket, the principles of the invention may be likewise applied to a gasket mounting supporting a panel on only one side thereof. Likewise, the particular shape of the expanding wedge 32 is disclosed merely for illustrative purposes. Various other shapes of mounting wedges may be used to accomplish similar results. Furthermore, while the invention has been described with particular reference to a mullion system which clamps to the head of the T-shaped wedge means, it will be readily understood that the mullion system may be used in connection with more conventional gaskets wherein the mullion clamps to a tongue which is an integral part of the gasket and merely extends therefrom for attachment to the mullion.

Although the invention has been described with particular reference to specific embodiments thereof, it will be readily understood by those skilled in the art that various modifications and variations may be resorted to without department from the spirit and scope of the invention as defined by the appended claims.

What is claimed is:

1. An interlocking mullion comprising a. a first plate having an inner surface and an outer surface, a leg extending from one end of the inner surface for mating with a support groove in a gasket, first and second parallel bosses extending from said inner surface and spaced from said leg, and an end face receiving means extending from said inner surface near the end opposite said leg;

b. a second plate having an outer surface and an inner surface positioned adjacent and parallel with said first plate means, a leg extending from one end of the inner surface for mating with a support groove in a gasket, a lug extending from said inner surface and between said first and second bosses, and an end face receiving means extending from said inner surface near the end opposite said leg;

c. stud means threadedly mounted in said first boss and mating with said lug to secure said first and second plates in a fixed relationship; and d. end face means mating with the ends of said first and second plates opposite said legs.

2. The mullion defined in claim 1 wherein said second boss extending from said first plate determines the separation distance between said first and second plates.

3. The mullion defined in claim 1 wherein said lug has an inclined surface and said stud mates with said inclined surface to urge said first and second plates together.

4. The mullion defined in claim 1 including bosses extending from the inner surfaces of said plates near the ends of said plates opposite said legs, said bosses providing means for supporting said end face means.

* * * * *